US006029751A

United States Patent [19]

Ford et al.

[11] Patent Number: 6,029,751

[45] Date of Patent: Feb. 29, 2000

[54] AUTOMATIC FIRE SUPPRESSION APPARATUS AND METHOD

[76] Inventors: Wallace Wayne Ford, 18314 Habberton Rd., Springdale, Ark. 72764; Terry Frank Gunnels, 1510 E. Apple Blossom, Lowell, Ark. 72745

[21] Appl. No.: 09/019,845

[22] Filed: Feb. 6, 1998

Related U.S. Application Data

[60] Provisional application No. 60/039,964, Feb. 7, 1997.

[51] Int. Cl.[7] ..... A62C 37/20

[52] U.S. Cl. ..... 169/60; 169/65

[58] Field of Search ..... 169/65, 70, 61, 169/60

[56] References Cited

U.S. PATENT DOCUMENTS

| | | | |
|---|---|---|---|
| 3,464,497 | 9/1969 | Globerman et al. | 169/60 |
| 3,517,746 | 6/1970 | Balmes, Jr. | 169/61 X |
| 3,653,443 | 4/1972 | Dockery | 169/2 R |
| 3,857,446 | 12/1974 | Kenny | 169/60 |
| 3,861,473 | 1/1975 | Livingston | 169/19 |
| 4,356,870 | 11/1982 | Gaylord et al. | 169/65 |
| 4,648,460 | 3/1987 | McCulloch | 169/60 X |
| 4,773,485 | 9/1988 | Silverman | 169/65 |
| 4,813,487 | 3/1989 | Mikulec et al. | 169/65 |
| 4,830,116 | 5/1989 | Walden et al. | 169/65 |
| 4,834,188 | 5/1989 | Silverman | 169/65 |
| 4,872,513 | 10/1989 | Gerdner et al. | 169/65 X |
| 4,979,572 | 12/1990 | Mikulec | 169/65 |
| 4,987,958 | 1/1991 | Fierbaugh | 169/65 X |
| 5,127,479 | 7/1992 | Stehling et al. | 169/65 |
| 5,129,386 | 7/1992 | Meister | 169/65 X |
| 5,297,636 | 3/1994 | North | 169/65 |
| 5,351,760 | 10/1994 | Tabor, Jr. | 169/65 |
| 5,461,365 | 10/1995 | Schlager et al. | 340/573 |
| 5,697,450 | 12/1997 | Stehling et al. | 169/65 |
| 5,868,205 | 2/1999 | Cunningham et al. | 169/65 |

OTHER PUBLICATIONS

Flag Fire, Protect Your Assets With Spaceman and Shurout NAF–S–III Automatic Fire Extinguishers, Why An Automatic System?, pp. 8,9.

*Primary Examiner*—Lesley D. Morris
*Attorney, Agent, or Firm*—Head, Johnson & Kachigian

[57] ABSTRACT

An automatic fire suppression unit and method for use in various fire exposures where the area in which a fire can occur is limited, manually operated portable extinguishment is either impractical or not recommended, the ability to provide additional suppression in the event of re-ignition is crucial to fire safety, or the ability to limit environmental impact of the fire suppressant is desired. The system includes a tank containing a suitable fire extinguishing agent and equipped with a temperature activated valve to discharge the extinguishing agent when a thermocouple or metallic alloy element responds to a high temperature condition and opens the valve. When the fire has been suppressed and a high temperature condition no longer exists, the valve automatically closes and stops the discharge of suppressant. Position indication contacts within the valve are utilized to activate appropriate alarms and to remove electrical or gas supply if necessary.

27 Claims, 12 Drawing Sheets

AUTOMATIC FIRE SUPPRESSION APPARATUS AND METHOD

CROSS-REFERENCE TO RELATED APPLICATIONS

This application is a continuation-in-part of U.S. provisional patent application Ser. No. 60/039,964, filed on Feb. 7, 1997, hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The present invention is directed to an apparatus, system, unit or device and method for the automatic suppression of fires. More particularly, the invention is directed to a unit for use in fire suppression where space and/or quantity of available suppressant is limited by necessity, cost, location, or desire for environmental protection. The invention has utility in applications such as fire suppression in confined spaces, aircraft cargo areas, on cook stoves, ranges, in utility rooms, heating and air closets, water heater closets, electrical control rooms, storage rooms, and can be adapted for use in laboratory hoods or any other area of potential fire hazard.

Fire extinguishing systems for cook stove or range hoods are shown in U.S. Pat. No. 3,653,443, issued to Dockery on Apr. 4, 1972; U.S. Pat. No. 4,773,485, issued to Silverman on Sep. 27, 1988; U.S. Pat. No. 4,813,487, issued to Mikulec et al. on Mar. 21, 1989; U.S. Pat. No. 4,830,116, issued to Walden et al. on May 16, 1989; U.S. Pat. No. 4,834,188, issued to Silverman on May 30, 1989; U.S. Pat. No. 4,979,572, issued to Mikulec on Dec. 25, 1990; and U.S. Pat. No. 5,351,760, issued to Tabor, Jr. on Oct. 4, 1994, each of which are hereby incorporated by reference.

U.S. Pat. No. 3,653,443 to Dockery (Dockery '443 or U.S. Pat. No. 3,653,443) discloses a pressure tank-type fire extinguishing system for use in the hood of a cooking range which uses a solenoid operated valve to fully discharge all of the extinguishing fluid in the tank, and provide a control signal to shut off electricity or gas supply to the cooking range burners. The system also provides control of an exhaust fan to expel fumes and smoke, an alarm circuit, and has manually controlled set and reset switches. The system can be manually reset or deactivated during the extinguishing discharge operation by pressing the reset switch. Once the system has been manually reset, the system will be automatically operated again if the thermostats indicate excessive temperatures. Dockery '443 has a particular disadvantage in that it is not easily retrofitted into an existing hood on a cooking range.

U.S. Pat. No. 4,773,485 to Silverman (Silverman '485 or U.S. Pat. No. 4,773,485) discloses a fire extinguishing system for use in a hood of a cooking range which includes a fire extinguisher and a pair of nozzles to disperse the extinguishing material. This system is controlled by a fusible link cable system which has a fusible link which melts in reaction to a fire and allows for a controlling actuator to move and allow the extinguishing system to release its full charge of fire suppressant. Silverman '485 has several disadvantages in that the system is complicated, has many moving parts, is not self-contained, and requires extensive modification to install inside the hood of a cooking range.

U.S. Pat. No. 4,813,487 to Mikulec (Mikulec et al. '487 or U.S. Pat. No. 4,813,487) discloses a fusible link, pressure vessel, fire extinguishing device. Also the system uses a micro-switch to activate a stove shut off mechanism to stop the flow of electricity to the stove if the fire extinguishing system is activated. The system uses a light emitting diode to provide a visual check that the system is operating properly during periods of inactivity. This system also uses multiple release nozzles, a one-shot fusible control link to detect heat, and discharges all of the extinguishing media onto the fire. Mikulec '487 has several disadvantages in that the system is complicated, requires substantial amounts of room behind the existing hood and the angle of mounting is limited.

U.S. Pat. No. 4,830,116 to Walden (Walden et al. '116 or U.S. Pat. No. 4,830,116) discloses another fire extinguisher for a stove hood with the pressure canisters located remotely from the hood and which shuts off the electric or gas supply to the stove in the event of a fire. This system uses heat sensors in the hood to activate the discharge of gaseous or liquid fire extinguishing agents, operate an exhaust fan, and activate an alarm system. This system also discharges the extinguishing agent in one release and utilizes an intermediate source of power to maintain the open position of the discharge controlling solenoids regardless of the temperatures sensed after activation has occurred. The discharge is maintained in the first pressure canister until it is almost completely discharged. When the first canister's discharge drops its internal pressure to 25 psi, a second pressure canister is also turned on. When the second canister drops to 25 psi, a delay timer for the exhaust fan is turned on. This delay allows for the canisters to complete their discharge and ensures that the exhaust fan is not turned on until both canisters are completely discharged.

U.S. Pat. No. 4,834,188 to Silverman (Silverman '188 or U.S. Pat. No. 4,834,188) like Silverman '485 described above discloses a fire extinguishing system having fused link cable control system for discharging a complete supply of pressure canister-type fire extinguisher onto a stovetop upon activation of the system. Silverman '188 has several disadvantages in that the system is complicated, is not self-contained, and requires extensive modification to install inside an existing hood for a cooking range.

U.S. Pat. No. 4,979,572 to Mikulec (Mikulec '572 or U.S. Pat. No. 4,979,572) like Mikulec '487 described above discloses an automatically activated fire extinguishing device for a stove. Mikulec '572 has several disadvantages in that the system is complicated, requires substantial room behind the existing hood, and the angle of mounting is limited.

U.S. Pat. No. 5,351,760 to Tabor, Jr. (Tabor, Jr. '760 or U.S. Pat. No. 5,351,760) discloses a pressure canister-type fire suppression system for use with a cook stove or range and which operates in several modes or stages to warn of, prevent, and extinguish stovetop fires. On sensing a first temperature increase, a fan is switched on. At a second temperature, an alarm is activated. At a third temperature, the stove is shut down. A fusible link is designed to melt at a temperature higher than the third temperature so that provisional measures may be activated prior to the dispensing of the fire retardant. The Tabor, Jr. fire suppression system is relatively complex and includes numerous working parts which are subject to failure, and the entire contents in the fire retardant canister are dispensed when the activation cable link melts. In accordance with a preferred embodiment, the fire retardant is a liquid potassium salt solution charged to approximately 195 psi and regulated to dispense through the nozzles at about 60 psi and at a droplet size of approximately 900 microns. The Tabor, Jr. '760 system requires an outside electrical energy supply in order to be operational, requires extensive hard wired components which are subject to damage, and makes retrofitting difficult due to problems in placing new wiring inside walls of existing structures.

All of the known pressure canister-type systems have particular disadvantages, such as those listed above. Typical high pressure canister-type systems depend on a cable system fusible link or thermal link-type of activation. Such a thermal link responds to elevated temperature by melting to activate the system. Once activated (melted), the system does not and cannot automatically reset. Thus, the canister-type systems will, if not manually interrupted, continuously disperse the fire suppressant until the charge is extinguished. This continuous discharge results in possible waste of extinguishing material, does not allow for a second or third discharge, and may lead to excessive damage to the environment and the protected structure.

Known high pressure canister-type systems which utilize environmentally unfriendly chemicals, such as Halon, also rely on a thermal link-type of activation system which releases all available fire suppressant, thus increasing the environmental impact in the event of a discharge. Other known high pressure canister systems require electrical power for system activation or reset, thus rendering these systems at least partially ineffective should a power loss occur.

The above-described fire extinguishing devices suffer from the drawbacks of being overly complicated, having numerous parts which are susceptible to failure, allow only one discharge of fire extinguishing material unless they are manually shut off during operation, are not environmentally friendly, and unless a manual reset is accomplished during the first activation, cannot automatically react to re-ignition of the fire that is to be extinguished. Further, the systems disclosed in the patents above do not appear to provide for an automatic fire retardant chemical or agent shut off following an initial discharge of fire retardant by sensing a reduction in temperature.

This "one shot" activation renders the conventional systems completely ineffective if a re-ignition should occur. Also, all known systems utilize a hard wired system of shutting down the stove's energy source. This makes the prospect of retrofit into an existing hood difficult. This hard wiring adds difficulty in retrofitting existing hoods or installing new hoods due to the routing of wiring through existing walls or the unsightliness of exposed wireways which makes these systems undesirable. Other known systems require electrical power for system activation or reset, thus rendering these systems at least partially ineffective should a power loss occur.

Water-based, piped, fire extinguishing and protection system sprinkler head-type controls or valves are disclosed in U.S. Pat. No. 3,857,446, issued to Kenny on Dec. 31, 1974; and U.S. Pat. No. 3,861,473, issued to Livingston on Jan. 21, 1975, each of which are hereby incorporated by reference.

U.S. Pat. No. 3,857,446 to Kenny (Kenny '446 or U.S. Pat. No. 3,857,446) discloses an actuator piston and a bi-metallic coil temperature sensitive actuator each used in a different water supply-type fire extinguishing sprinkler control to open and close sprinkler valves at predetermined temperatures. Kenny '446 uses a spring-loaded, snap action valve to open and close the sprinkler systems in response to the slow movement of a temperature sensitive actuator and locates the valve in the high temperature fire hazard area.

U.S. Pat. No. 3,861,473 to Livingston (Livingston '473 or U.S. Pat. No. 3,861,473) discloses another type of temperature sensitive actuator used in a water supply-type fire extinguishing sprinkler control to open and close sprinkler valves at predetermined temperatures. Livingston uses a thermovalve motor, gate valve member, and a pressurized gas flow control unit for controlling the dispersion of water. This system reduces the water demand on the system in low pressure situations so that only those areas in critical need, where the temperature has exceeded 500 degrees F., are supplied with water.

The above-described fire extinguishing devices suffer from the drawbacks of placing the valve and water supply directly in the high temperature area that is exposed to the fire hazard. Special adaptations for the reduction of grease and other types of buildup are therefore necessary to maintain the long term operable life of the extinguishing unit. Furthermore, these system are limited in their applicability because they do not provide for a simple, self-contained, transportable, or retrofit system for fire extinguishing protection. Nor do these water-based systems provide for a way to disconnect a heat source or operate an alarm.

Commercially available industrial powder or dry chemical fire extinguishing systems for use in restaurants and the like do not provide for the shutting off of the stove, the sounding of an alarm, or the cessation of discharge of the fire retardant chemical or agent upon extinguishment of the fire.

Hence, there is a need for an eloquently simple, high pressure, self-contained, canister-type fire extinguishing or suppression system with an automatic controlling system which releases only the amount of extinguishing agent which is necessary to extinguish the fire, limits the discharge of environmentally unfriendly materials in the event of a fire, retains any remaining extinguishing agent for use in case of a re-ignition or subsequent fire, is operable to suppress fires regardless of the condition of external power sources, can control and remove heat sources from the fire hazard area, which facilitates retrofitting thereof, and/or can provide for an alarm.

BRIEF SUMMARY OF THE INVENTION

In accordance with the present invention, an improved fire extinguishing or suppression apparatus, system, unit, or device and method is provided which addresses the drawbacks of the prior art devices and in one of its exemplary forms includes a cylinder of fire suppressant, a snap action thermocouple control valve, a thermocouple bulb adapted to be mounted within the fire hazard area, a discharge nozzle assembly, alarm relay, alarm, and electric gas valve or electrical circuit disconnect.

In accordance with the present invention a means is provided by which only the amount of fire suppressant required to extinguish the flame is released and the remaining fire suppressant is retained to be released in the event of re-ignition. Also, in accordance with the present invention, a means is provided for limiting the release of environmentally unfriendly chemicals in the event of a discharge. The present invention also provides for fire suppressant action regardless of a power loss. Further, the present invention provides a system which is easily retrofitted into an existing hood without the need for extensive wiring modifications.

In accordance with a preferred embodiment of the present invention, a fire suppression unit includes a pressurized cylinder, containing nitrogen as a propellant, operatively attached by tubing to a temperature activated valve which is also operatively attached by tubing to a cylinder of any suitable fire suppressant which is operatively connected, either directly or by piping, to a discharge nozzle. Activation of the temperature activated valve is accomplished through the expansion of a metal alloy temperature sensitive element within the valve body. The dispersion nozzle and temperature activated valve are placed in the fire exposure area to be properly located to detect the presence of a fire condition and to properly disperse the fire suppressant into the fire exposure area. The temperature activated valve is equipped with internal position contacts which are electrically connected to external circuit control connection terminals providing control circuitry for alarm activation and for heat source removal. When the temperature activated valve is no longer exposed to the intense heat of a fire, the valve closes and prevents further discharge of fire suppressant. Also, in its closed position, the valve is ready to be reactivated or opened for an additional discharge of fire suppressant in the event of fire re-ignition or a subsequent fire.

In the preferred embodiment, the unit is installed within a vent-a-hood over a residential or industrial cook stove and concealed from view. The unit is connected to lithium battery-powered, electronic circuitry which sends a radio frequency signal to a receiver which in turn activates a control circuit within a remote energy removal unit to disconnect gas or electricity from the stove and eliminate or shut off the heat sources or burners. Alarm means is provided through electronic monitoring of the valve position contacts.

In accordance with another embodiment of the present invention, a fire suppression unit is provided including a base automatic unit having a pressurized cylinder containing any suitable fire suppressant connected, either directly or by piping, to a snap action, thermocouple activated valve. Piping connects the thermocouple activated valve to one or more dispersion nozzles. Thermocouple valve activation is accomplished by the expansion of a suitable liquid within a thermocouple bulb. The dispersion nozzle and thermocouple bulb are placed in the fire exposure area to be properly located to detect the presence of a fire condition and to properly disperse the fire suppressant into the fire exposure area. The thermocouple valve is equipped with internal position contacts, which are normally open, but upon valve activation are closed and connected to external circuit control connection terminals providing control circuitry for alarm activation and for heat source removal, if required or desired. When the thermocouple bulb is no longer exposed to the intense heat of a fire, the valve closes and prevents further discharge of fire suppressant. Also, in its closed position, the valve is ready to be reactivated or opened for an additional discharge of fire suppressant in the event of fire re-ignition or another subsequent fire.

In accordance with another example of the present invention, the unit is equipped with multiple thermocouple valves and/or dispersion nozzles to allow for appropriate coverage of larger fire areas such as in an aircraft cargo area or large utility vault area.

In accordance with another example, the unit has multiple canisters or a cascaded canister system to provide for sufficient quantities of fire suppressing material for the coverage area.

In accordance with another example, the unit is connected to electronic circuitry which is used to remove heat sources by disconnecting the gas or electricity in fire areas such as water heater closets and heating and air conditioning closets.

In accordance with yet another example, the unit is installed within a vent-a-hood over a cook stove concealed from view and is connected to electronic circuitry which is used to remove heat sources such as gas or electricity from the stove. Alarm means is provided through electronic monitoring of the valve position contacts.

The present invention is also directed to an automatic home fire suppression unit or units adapted to automatically activate under extreme heat and discharge a non-toxic gas referred to as FM200 which acts as a flame retardant by attacking the molecules that are burning. These units are adapted to be located in the hot spots in a home which include the kitchen, hot water heater, furnace, and/or storage room. The kitchen unit is adapted to fit into the stove vent hood and automatically opens for discharge of the non-toxic gas when a thermocouple senses the extreme heat produced by a stovetop fire. The unit shuts off the stove and also sounds an alarm upon the sensing of a stovetop fire. The unit ceases to discharge the non-toxic fire retardant gas when the thermocouple senses that the fire has been extinguished.

The principal object of the present invention is to provide an automatic fire suppression apparatus and method. Another object of the present invention is to provide a means by which only the amount of fire suppressant required to extinguish the flame is released and the remaining fire suppressant is retained to be released automatically in the event of re-ignition or another fire.

Another object of the present invention is to provide a means of limiting the release of environmentally unfriendly chemicals in the event of a discharge.

A still further object of the present invention is to provide application of the needed fire suppressant regardless of electrical power loss.

Still another object of the present invention is to provide a fire suppression apparatus, system, unit, or device which is easily retrofitted into an existing hood without the need for extensive wiring modifications.

Yet another object of the present invention is the provision of an eloquently simple, high pressure, self-contained, canister-type fire extinguishing system with an automatic control system which releases only the amount of extinguishing agent which is necessary to extinguish the fire, limits the discharge of environmentally unfriendly materials in the event of a discharge, retains any remaining extinguishing agent for use in case of a re-ignition or subsequent fire, is operable to suppress fires regardless of the condition of external power sources, can control and remove heat sources from the fire hazard area, and/or can provide for an alarm.

Other objects and further scope of the applicability of the present invention will become apparent from the detailed description to follow, taken in conjunction with the accompanying drawings wherein like parts are designated by like reference numerals.

BRIEF DESCRIPTION OF THE SEVERAL VIEW OF THE DRAWING

DETAILED DESCRIPTION OF THE INVENTION

Figure 1:
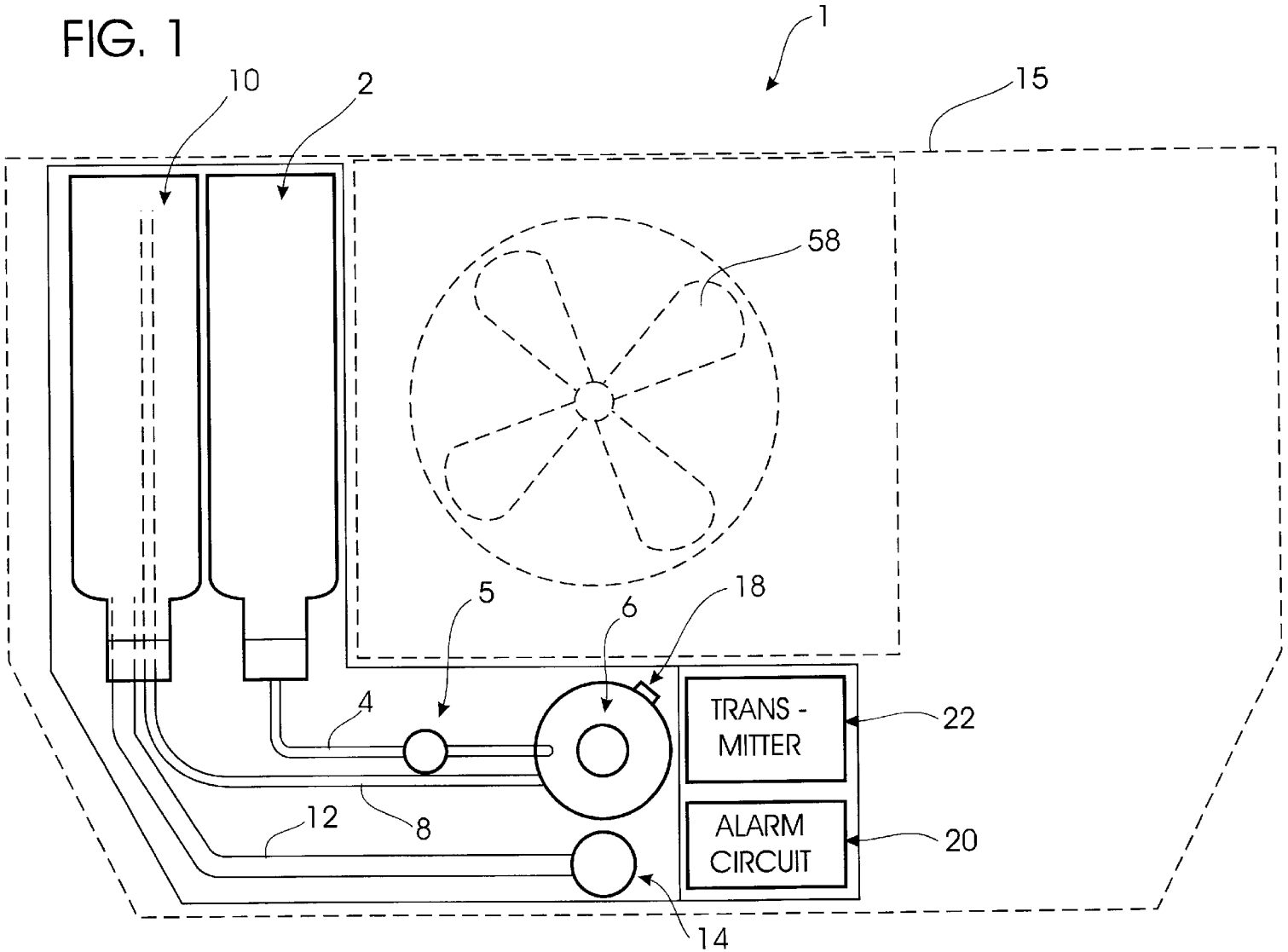
FIG. 1 is a top plan view illustration of an automatic fire suppression base unit in accordance with an exemplary embodiment of the present invention.
Figure 2:
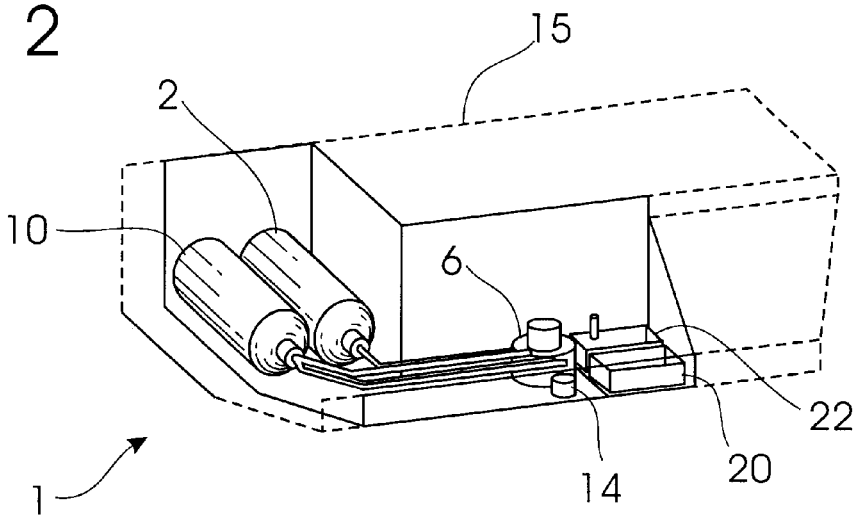
FIG. 2 is a perspective view representation of the base unit of FIG. 1 and a remote energy removal unit showing the preferred installation of a fire suppression system for an electric range and vent-a-hood.
Figure 2:
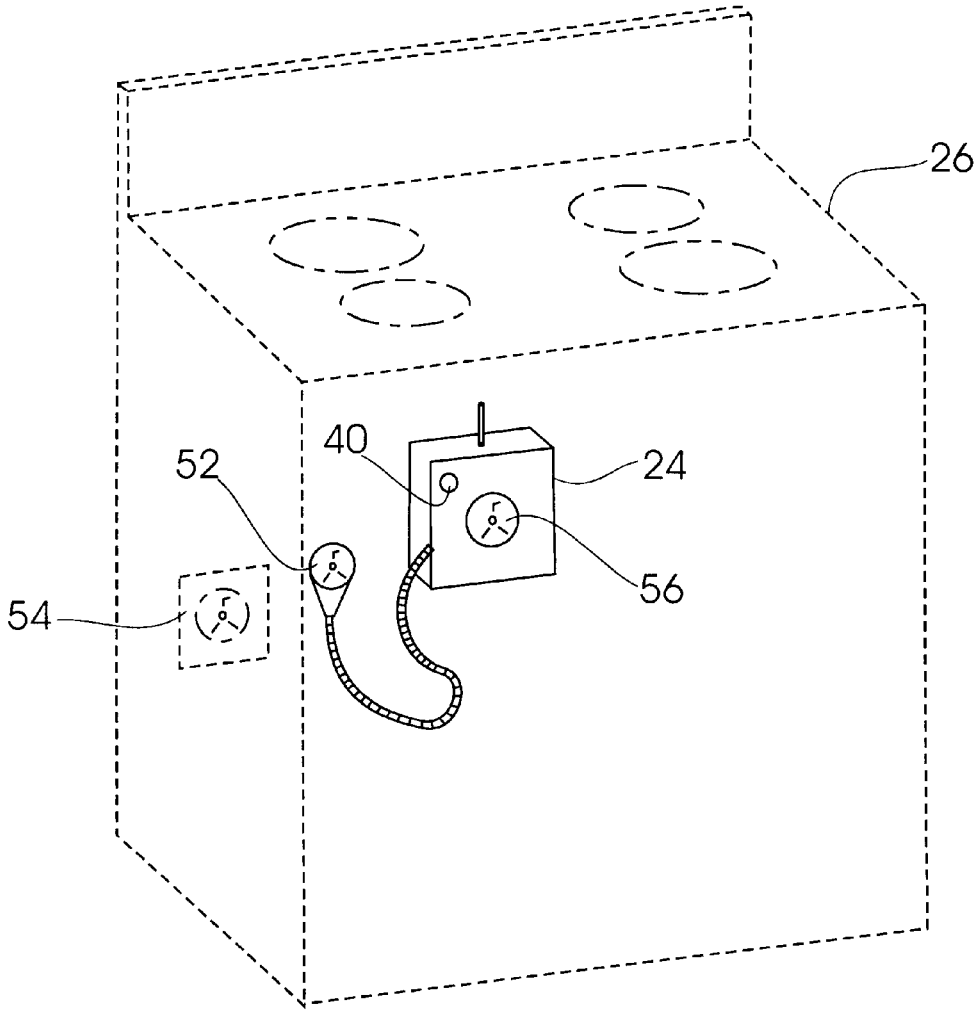

With reference to FIGS. 1–5 of the drawings, there is shown an exemplary embodiment of a fire suppression unit 1 including a pressurized cylinder 2 which contains nitrogen or other inert gas, which acts as the propellant for the fire suppressant material. The cylinder 2 is connected by piping or tubing 4, through a pressure sensor or switch 5, to a snap action, temperature activated valve 6. Piping or tubing 8 connects the temperature activated valve 6 to a cylinder 10 of fire suppressant chemical or material which is connected by piping or tubing 12 to at least one dispersion nozzle 14. Activation (opening) of the temperature activated valve 6 is accomplished through the expansion of a temperature sensitive material such as a metallic alloy element within the valve body. When the valve 6 is no longer exposed to the intense heat of a fire, the valve 6 closes and prevents further discharge of fire suppressant material. Also, in its closed position, the valve 6 is ready to be reactivated or opened for an additional discharge of fire suppressant in the event of fire re-ignition or subsequent fire.

Dispersion nozzle 14 and temperature activated valve 6 are placed in the fire exposure area, for example, centrally in a stove hood 15, to be properly located to detect the presence of a fire condition and to properly disperse the fire suppressant into the fire exposure area. The temperature activated valve 6 is equipped with internal position contacts 16 which when the valve 6 is activated (opened) connect to an external circuit control connection terminal 18 providing a control signal for activation of alarm circuitry 20 and transmitter 22 which itself activates a remote energy removal unit 24 to provide for heat source removal.

Dispersion of fire suppressant from cylinder 10 is accomplished in the following manner. As the temperature increases, the metallic alloy element within the temperature activated valve 6 expands to cause the usually closed temperature activated valve 6 to open at a preset temperature. This preset temperature is typically around 250 degrees F. or higher. The compressed propellant gas contained within pressurized cylinder 2 is released to flow through line 8 and pressurizes the cylinder 10 of fire suppressant chemical such as a conventional fluid or powdered fire suppressant material. The propellant and suppressant chemical or material are then expelled through the piping or line 12 and out through the dispersion nozzle 14 to extinguish the fire or flame. With the extinguishing of the flame and the subsequent reduction in temperature, the metallic alloy element in the temperature activated valve 6 contracts and causes the temperature activated valve 6 to close. This closure shuts off the compressed gas supply cylinder 2 and thus, retains a portion of the pressured gas within pressurized cylinder 2 and a portion of the fire suppressant in cylinder 10 for later dispersion should re-ignition or a subsequent fire occur.

In the preferred embodiment, the fire suppression unit 1 is installed within a vent-a-hood 15 over a cook stove 26 concealed from view and is connected to electronic circuitry which utilizes radio transmitter 22 and a receiver 28 to activate remote energy removal unit 24 which is used to remove heat sources by disconnecting the gas or electricity from the stove.

Figure 3:
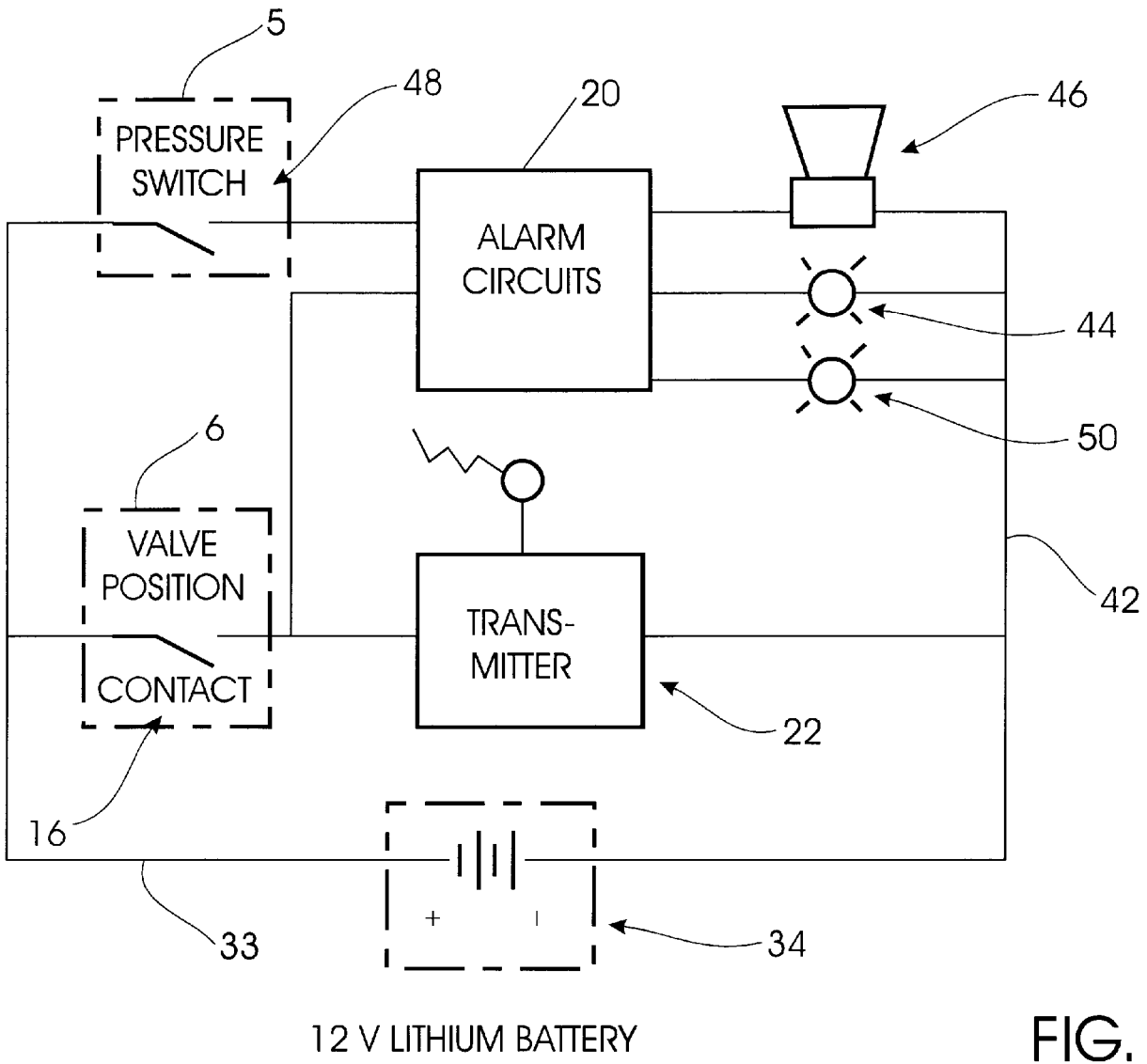
FIG. 3 is a schematic circuit diagram of the base unit of FIG. 1.
Figure 4:
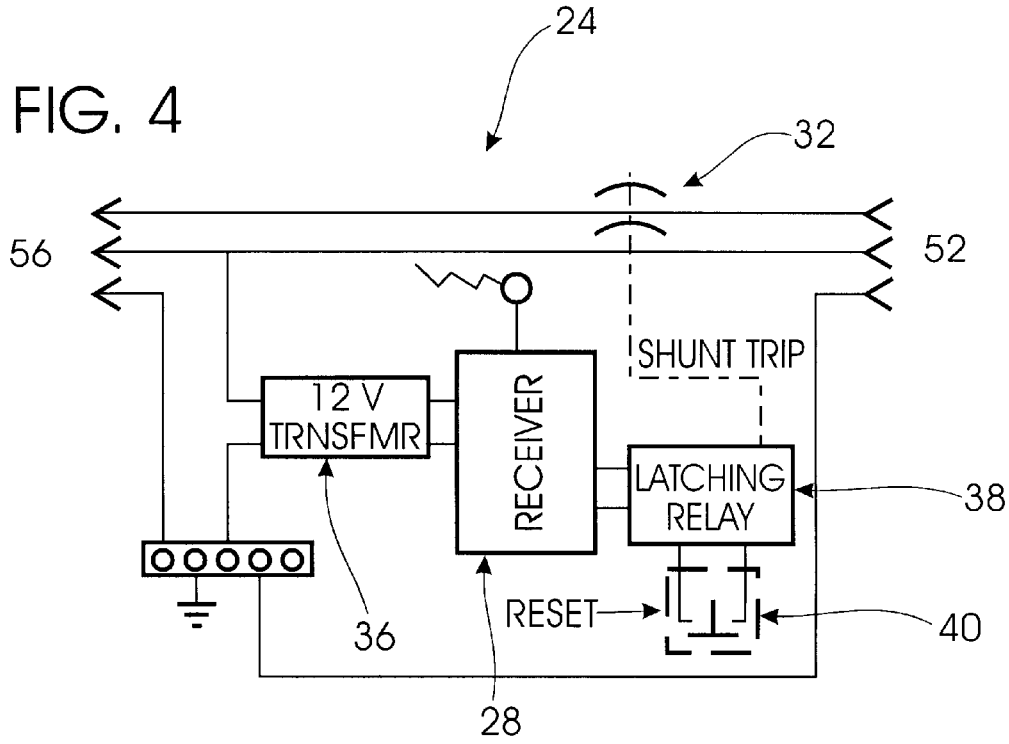
FIG. 4 is a schematic circuit diagram of the remote energy removal unit in an installation in a fire suppression system which requires the removal of electrical sources of heat (FIG. 2).
Figure 5:
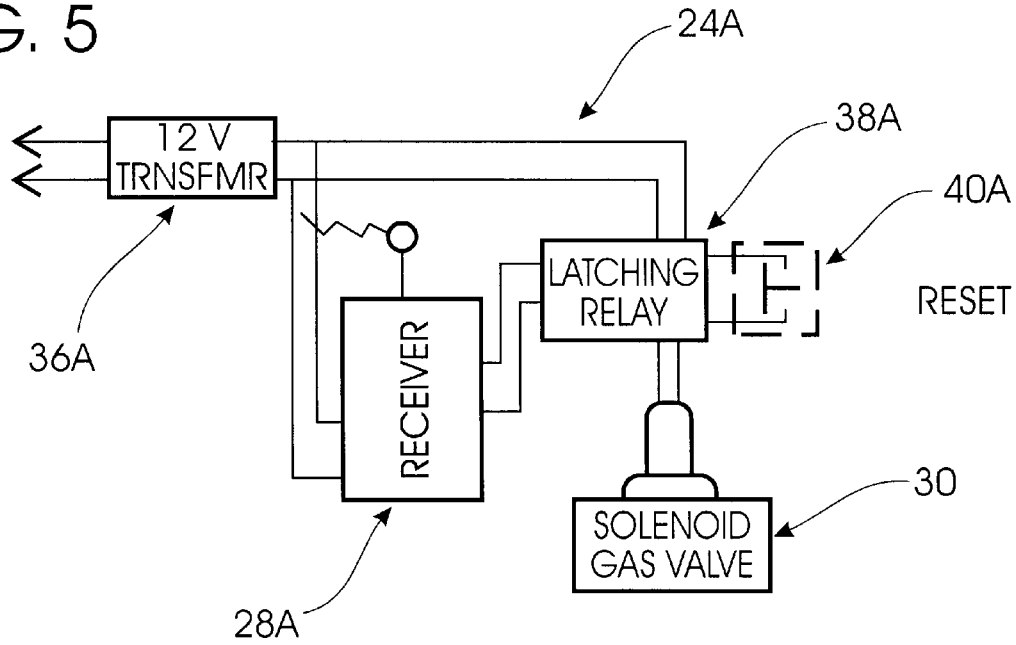
FIG. 5 is a schematic circuit diagram of the remote energy removal unit in an installation within a fire suppression system which requires the removal of gas-supplied sources of heat.

As schematically shown in FIGS. 3, 4, and 5 of the drawings, removal of sources of heat by disconnecting gas or electrical energy from the stove is accomplished by utilizing the internal position contacts 16 of the temperature activated valve 6 to activate electronic circuitry which drives low frequency radio transmitter 22 to send a signal to radio receiver 28 within the remote energy removal unit 24 which is connected to electronic circuitry to either close a solenoid gas valve 30 or open an electrical relay 32.

As shown in FIGS. 3 and 4 of the drawings, for electrical energy removal, wiring 33 connects a lithium battery power source 34 to the valve position contacts 16. Upon system activation (opening of valve 6), the position contacts 16 close or make contact and power from the battery source 34 flows through the valve position contacts 16 and activates the radio transmitter 22. The signal from the transmitter 22 is then sent to the receiver 28 of remote energy removal unit 24. Upon receiving the radio signal, the receiver 28 allows power to flow from a transformer 36 to a latching relay 38 which latches in the open position, which opens electrical relay 32 and disconnects the electrical power from an electrical appliance such as a range top, stove, electric water heater, fan, etc. Latching relay 38 is then locked in the open position to prevent re-energizing of the appliance until the system reset button 40 is pressed.

After the system reset button 40 has been pressed, power from transformer 36 is prevented from flowing through receiver 28 and on to latching relay 38 which leaves electrical relay 32 closed and allows for electrical power to pass to the electrical appliance.

In reference to FIGS. 3 and 5 of the drawings, for gas shut off, wiring 33 connects the lithium battery power source 34 to the valve position contacts 16. Upon system activation, power from the battery source 34 travels through the valve position contacts 16 and activates the radio transmitter 22. The signal from the transmitter 22 is then sent to receiver 28A of the remote energy removal unit 24A. Upon receiving the radio signal, the receiver 28A allows power from transformer 36A to flow to latching relay 38A which latches in the open position, removing power from electrical solenoid 30 which then closes to shut off the gas supply. Latching relay 38A is locked in the open position to prevent re-energizing of solenoid valve 30 until the system reset button 40A is pressed.

After the system reset button 40A is pressed, power from transformer 36A is prevented from flowing to latching relay 38A by receiver 28A. Thus, latching relay 38A remains closed and power is provided to solenoid gas valve 30 to maintain the valve 30 open and provide gas to the appliance.

In accordance with a preferred embodiment of the invention and as shown in FIGS. 1 and 3 of the drawings, alarm indication is provided by the activation of valve 6 and the closing of the valve position contacts 16. For typical alarm indication, wiring 33 and 42 connects the lithium battery power supply 34 to the temperature activated valve position contacts 16. Upon valve 6 activation, the internal position contacts 16 close and power is applied to the alarm circuitry 20 which activates alarm light 44 and alarm horn 46.

In addition to the alarm indication provided above, the unit is also equipped with a low pressure alarm or light 50. Power from the lithium battery power source 34 is applied to system pressure switch contacts 48 of pressure switch 5. When system pressure is reduced below a predetermined pressure, the pressure switch contacts 48 close and power is applied to the alarm circuitry 20 and to the system low pressure light 50.

With reference again to FIG. 2 of the drawings, the remote energy removal unit 24 includes a plug or male connector 52 adapted to be received in the wall outlet or female socket 54. Further, the remote energy removal unit 24 includes a female receptacle or socket 56 adapted to receive the male plug or electrical connector of the appliance, stove, range, or the like 26. Hence, the remote energy removal unit 24 is received in line between the wall outlet 54 and the electrical plug of the appliance.

It is to be understood that the canisters or tanks 2 and 10 may be replaced and refilled as necessary. For example, when pressure switch 5 senses lower pressure and activates low pressure alarm 46 and/or low pressure light 50, the system or unit user will know it is time to replace or refill the canisters or tanks 2 and 10.

The fire suppression apparatus, system, unit, or device 1 is compact and simple in construction, easy to retrofit into a conventional hood having an exhaust fan 58, is easy to maintain, and operates automatically.

Figure 8:
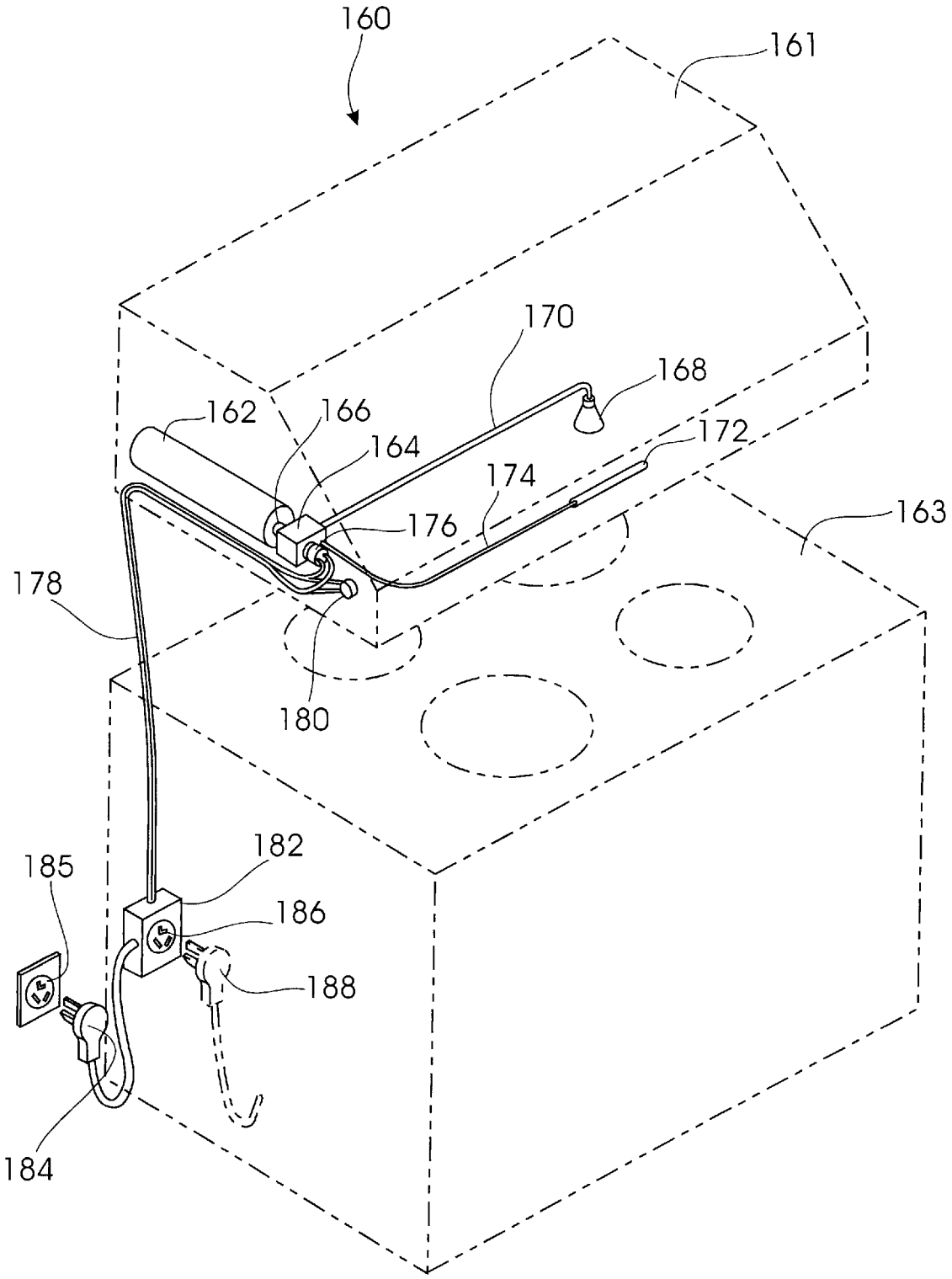
FIG. 8 is a perspective view illustration of another embodiment of an installation of a fire suppression system of the present invention in a range vent-a-hood.
Figure 14:
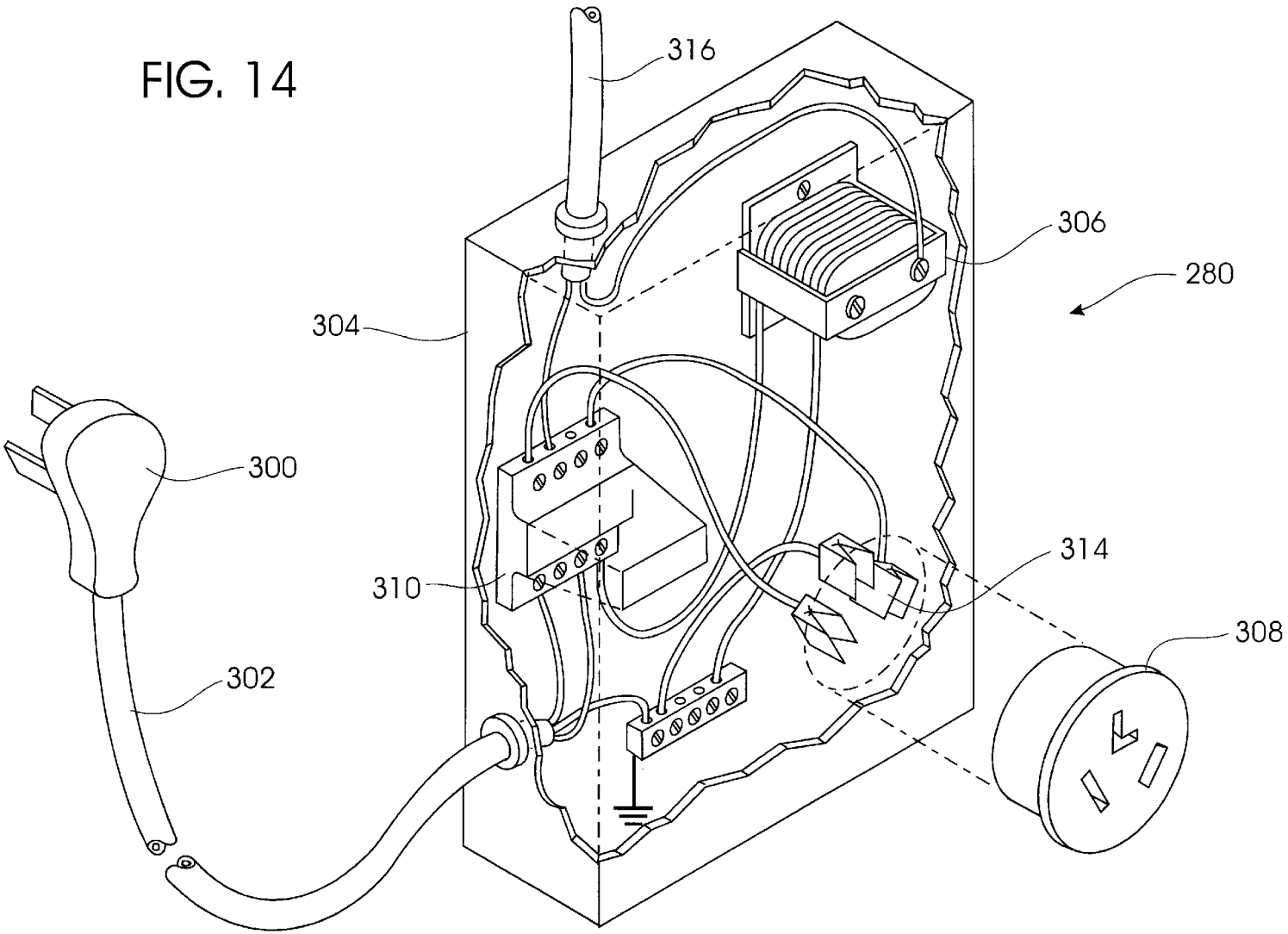
FIG. 14 is a perspective view representation of an electrical heat source disconnect or removal unit in accordance with one embodiment of the present invention.

Although it is preferred to have a battery-operated power system (FIG. 3) for the fire suppression unit 1, it is contemplated that one may eliminate the transmitter and receiver by hard wiring the base unit control circuitry to a power shut off device such as shown in FIGS. 8 and 14.

Still further, although the suppression unit 1 is shown with a single temperature sensitive actuator valve 6 and fire suppressant nozzle 14, it is contemplated that the device may include a plurality of temperature actuated valves and/or a plurality of fire suppressant dispersing nozzles 14. See, for example, FIGS. 7 and 13.

Moreover, the electrical circuit of FIG. 3 may include a low battery level alarm or light which alerts the user to a low level of energy in the battery 34 and indicates that the battery needs replaced or recharged.

Figure 6:
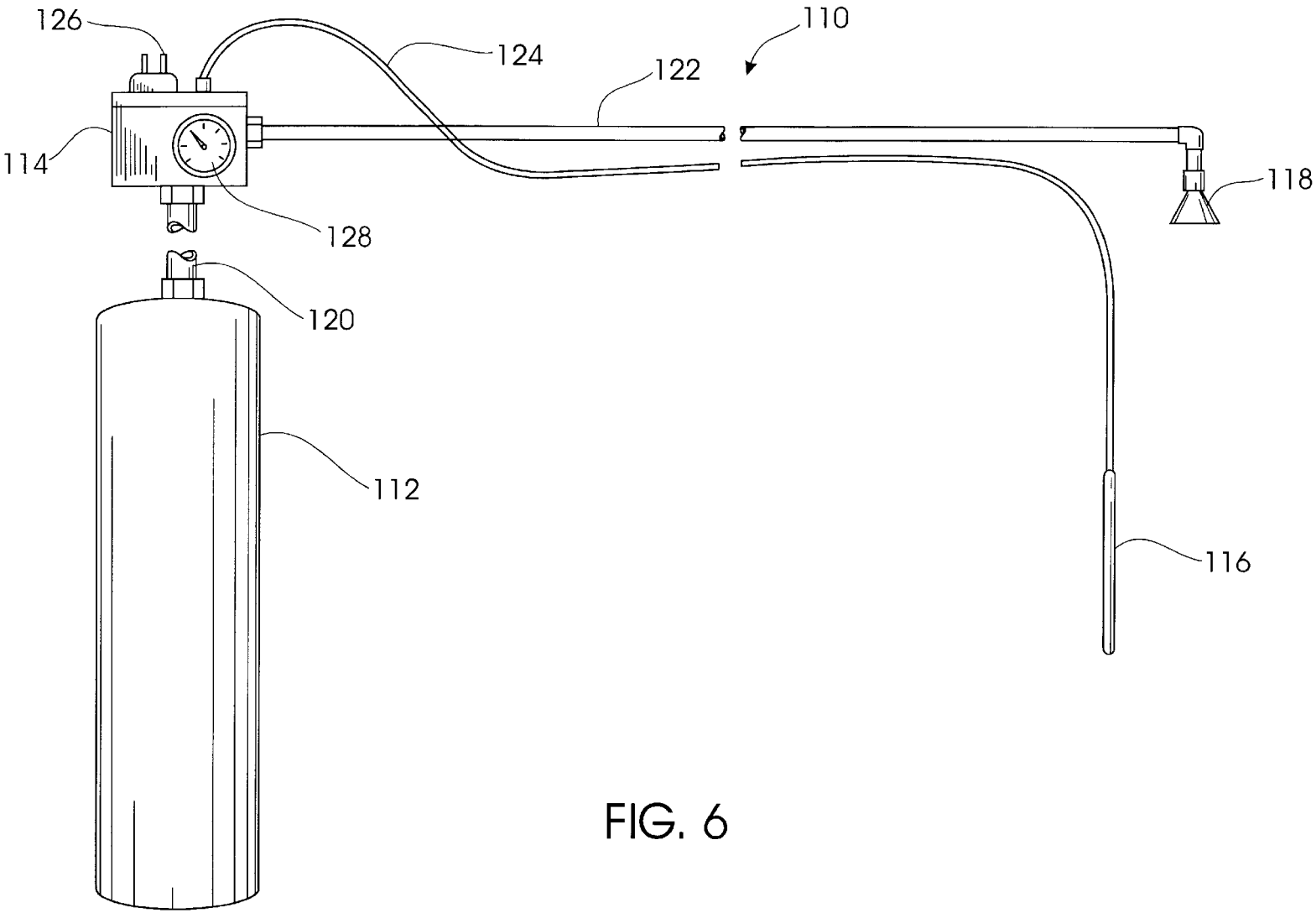
FIG. 6 is a side plan view of another embodiment of an automatic fire suppression unit of the present invention.

In accordance with another exemplary embodiment of the present invention as shown in FIG. 6 of the drawings, a fire extinguishing apparatus, device, or assembly is generally designated by the reference numeral 110 and includes as major components a pressurized cylinder 112, a snap action, thermocouple activated valve 114, a thermocouple bulb 116, and a dispersion nozzle 118. Pressurized cylinder 112 containing any suitable fire suppressant material, for example $CO_2$, FM200, and/or dry chemical, is connected to the snap action, thermocouple activated valve 114 by piping, tubing, or line 120, or if the application permits, the piping 120 can be eliminated and the connection of the pressurized cylinder 112 to the thermo-couple activated valve 114 can be made directly. The quantity and the type of suppressant contained within the pressurized cylinder 112 will vary depending upon the specific application.

The connection of the thermocouple activated valve 114 to the dispersion nozzle 118 is made by piping, tubing, or line 122, or if the application permits, this connection can also be made directly, and the piping 122 may be eliminated.

The thermocouple valve 114 is connected to the thermocouple bulb 116 by a flexible conduit 124. The activation of the thermocouple valve 114 is accomplished by the thermal expansion of suitable liquid or element within the thermocouple bulb 116 which causes fluid to travel along conduit 124 to valve 114, wherein the additional fluid causes the valve to open.

Dispersion nozzle 118 and thermocouple bulb 116 are placed in the fire exposure area so that the thermocouple bulb 116 can detect the presence of a fire condition and the dispersion nozzle 118 can properly disperse the fire suppressant into the fire exposure area. The thermocouple valve 114 is connected to an external circuit control connection terminal 126 providing a signal for external control circuitry and further connection to an alarm, heat removal system, or other applicable device. The valve or valve housing 114 supports a pressure gauge 128 which provides an indication of the pressure or charge in tank 112. If the gauge 128 shows a low pressure or low charge condition, then the tank 112 is either recharged or replaced.

Figure 7:
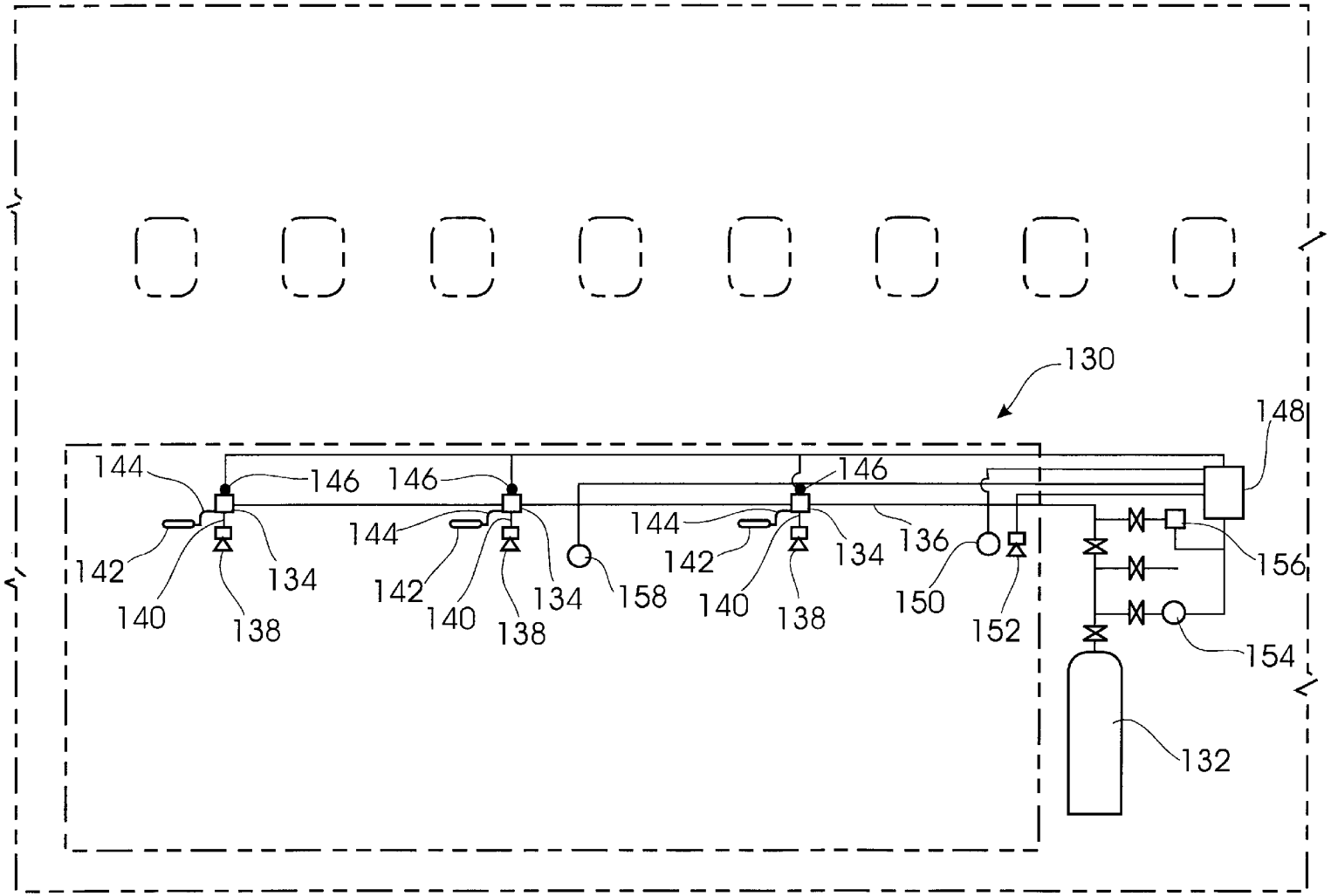
FIG. 7 is a schematic side plan view representation of an installation of a fire suppression system of the present invention in an aircraft cargo area.

With reference to FIG. 7, there is shown an enclosed area, such as the cargo hold of an airplane, and a multiple nozzle fire suppression unit 130 including a pressurized cylinder 132 containing any suitable fire suppressant material, such as a gas, fluid, and/or powder, connected to multiple snap action, thermocouple activated valves 134 by piping, tubing, or line 136. The quantity and the type of suppressant contained within the pressurized cylinder 132 will vary depending upon the specific application.

The connection of each of the thermocouple activated valves 134 to the respective multiple dispersion nozzles 138 is made by a piping, tubing or line 140, or if the application permits, this connection can be made directly, and the piping 140 may be eliminated.

The respective thermocouple valves 134 are each connected to a thermocouple bulb 142 by means of flexible conduit 144. The activation of the thermocouple valves 134 is accomplished by the expansion of suitable liquid or element within the thermocouple bulbs 142.

Dispersion nozzles 138 and thermocouple bulbs 142 are placed at spaced locations in the fire exposure area so that the thermocouple bulbs 142 can detect the presence of a fire condition and the dispersion nozzles 138 can properly disperse the fire suppressant into the fire exposure area. The thermocouple valves 134 are each connected to an external circuit control connection terminal 146 providing a signal for a control box 148, external alarm light 150 and siren 152 for alarm activation and to heat source removal means for heat source removal if required by the application. The thermocouple valves 146 can also contain pressure indicators or gauges (not shown) for monitoring of the pressure at the valves or within the pressure cylinder 132.

Figure 12:
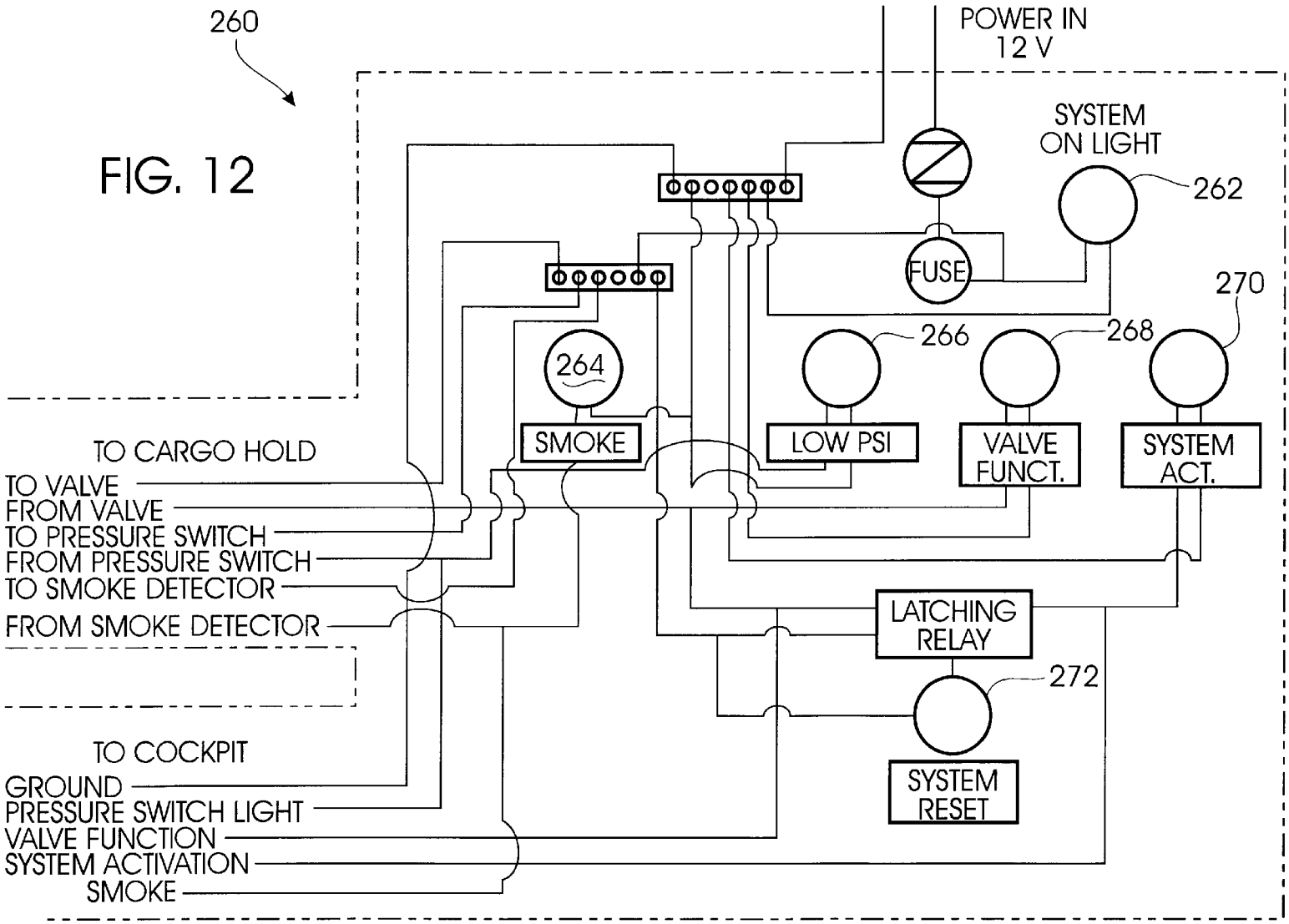
FIG. 12 is a schematic circuit diagram of the unit installation within a fire suppression system for an aircraft area (FIG. 7).

The alarm signal from control box 148 can also be routed to a remote location such as a control room or cockpit to alert ground control or the pilot of a fire and suppression system activation (FIG. 12).

Also, the system 130 may include a low pressure sensor 154, valve function sensor 156, and a smoke and/or $CO_2$ sensor or detector 158.

As shown schematically in FIG. 7, the system 130 uses multiple dispersion nozzles 138 which are connected to respective multiple thermocouple valves 134 to allow for appropriate coverage of larger fire areas such as an aircraft cargo area or large utility vault area. Each thermo-couple valve 134 operates independently, as detailed above, to detect an increase in temperature and open to dispense the suppressant material only within the area of coverage of the particular nozzle 138 attached to the thermocouple valve 134 which is activated. Control means 148 is connected to all of the thermocouple valves 134 and monitors the positions of the valves 134 and the pressure remaining in the pressure cylinder 132 to activate alarms 150 and 152 upon an opening of at least one of the thermocouple valves 134 to discharge the fire suppression material, and to activate the alarms 150 and 152 when the system is nearing an exhaustion of all of the fire suppression material in tank 132 and has a correspondingly low system pressure.

FIG. 8 shows a stove or range hood concealed fire suppression apparatus 160 having components similar in construction to that of system 110 of FIG. 6 and being installed within a vent-a-hood 161 over a cook stove 163 and concealed from view. The apparatus 160 includes a pressurized cylinder 162 containing any suitable fire suppressant material, such as $CO_2$, FM200, and/or dry chemical, connected to a snap action, thermocouple activated valve 164 by piping 166, or if the application permits, the piping 166 can be eliminated and the connection of the pressurized cylinder 162 to the thermocouple activated valve 164 can be made directly. The quantity and type of suppressant contained within the pressurized cylinder 162 will vary depending upon the specific application.

The connection of the thermocouple activated valve 164 to the dispersion nozzle 168 is made by piping 170, or if the application permits, this connection can also be made directly, and the piping 170 may be eliminated.

The thermocouple valve 164 is connected to a thermocouple bulb 172 by means of a fluid conduit 174. The activation of the thermocouple valve 164 is accomplished by the thermal expansion of suitable liquid or element within the thermocouple bulb 172.

Dispersion nozzle 168 and thermocouple bulb 172 are placed in the fire exposure area so that the thermocouple bulb 172 can detect the presence of a fire condition and the dispersion nozzle 168 can properly disperse the fire suppressant onto the fire. The thermocouple valve 164 is connected to an external circuit control connection terminal 176 providing a signal for external control circuitry. This terminal is connected by signal carrier or wiring 178 to an alarm light and/or siren 180, a heat source removal means 182, and to any other applicable device.

The apparatus 160 is connected to a heat source removal means which is shown as an electrical supply removal means 182 which is illustrated as electronic circuitry which is used to remove heat sources by disconnecting electricity from the stove (FIG. 14). The heat source removal device 182 includes a male plug 184 adapted to be plugged into a conventional wall outlet 185, and a female socket 186 adapted to receive a conventional male plug 188 of the stove or range 163. The heat source removal means 182 will be explained in further detail below. Alarm means 180 is also provided to monitor the valve position and the system pressure and provide a visual or audible warning as described above.

Figure 9:
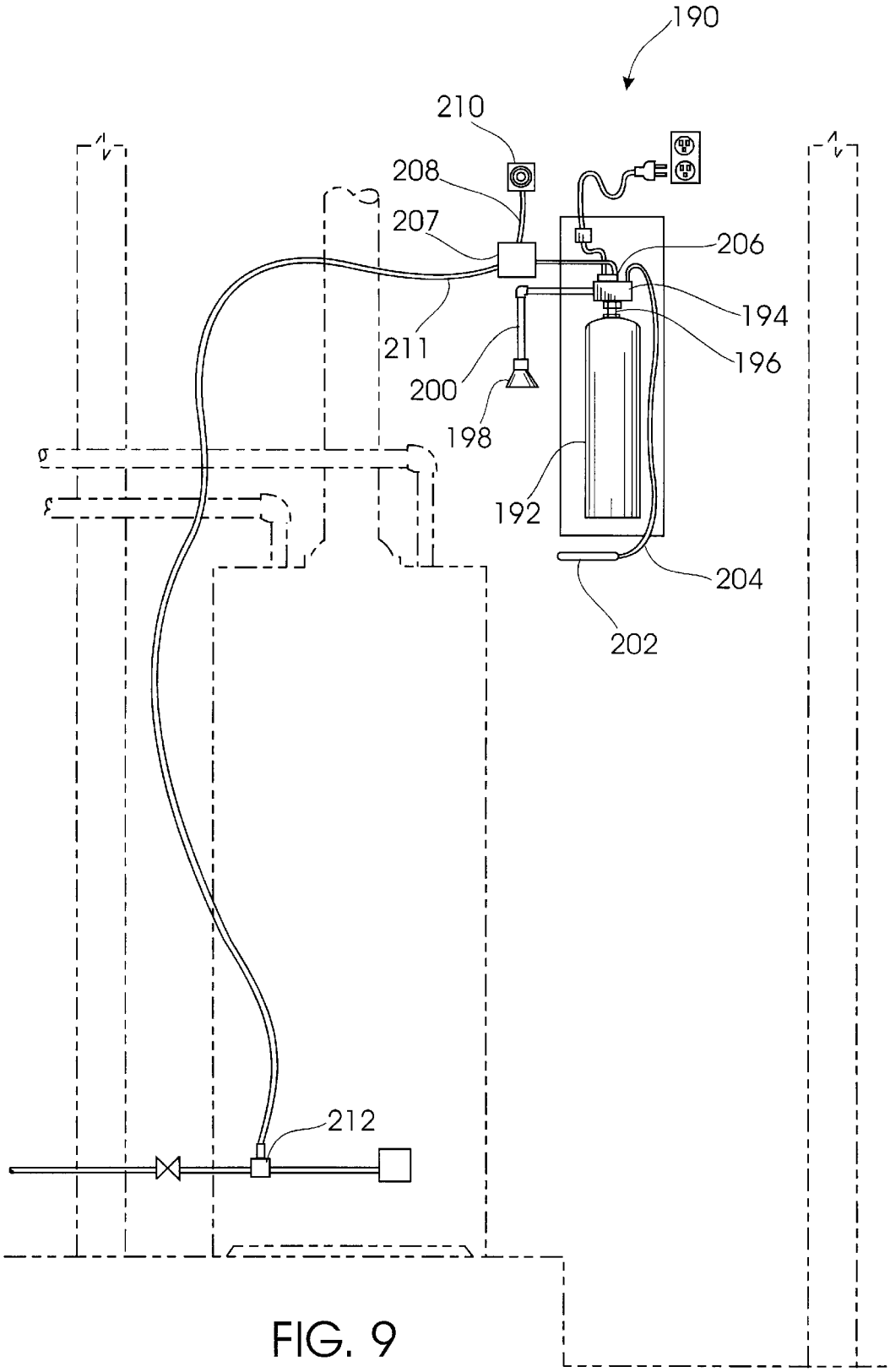
FIG. 9 is a side view representation of another installation of a fire suppression system of the present invention in a water heater closet.

In accordance with another embodiment of the invention as shown in FIG. 9, a utility room version of the fire suppression protector system 190 is shown to include a pressurized cylinder 192 containing any suitable fire suppressant material connected to a snap action, thermocouple activated valve 194 by piping 196, or if the application permits, the piping 196 can be eliminated and the connection of the pressurized cylinder 192 to the thermo-couple activated valve 194 can be made directly. The quantity and type of suppressant contained within the pressurized cylinder 192 will vary depending upon the specific application.

The connection of the thermocouple activated valve 194 to at least one dispersion nozzle 198 is made by piping 200, or if the application permits, this connection can also be made directly, and the piping 200 may be eliminated or additional nozzles and piping may be added.

The thermocouple valve 194 is connected to a thermocouple bulb 202 by a conduit 204. The activation of the thermocouple valve 194 is accomplished by the thermal expansion of suitable liquid or element within the thermocouple bulb 202.

Dispersion nozzle 198 and thermo-couple bulb 202 are placed in the fire exposure area so that the thermocouple bulb 202 can detect the presence of a fire condition and the dispersion nozzle 198 can properly disperse the fire suppressant into the fire exposure area. The thermo-couple valve 194 is connected to an external circuit control connection terminal 206 providing a signal for external control circuitry or box 207 connected by signal carrier or wire 208 to an alarm light and/or siren 210 and a signal carrier or wire 211 to heat source removal control valve 212, or to any other applicable device.

The fire suppression protector system 190 as shown in FIG. 9 is connected to a heat source removal control valve 212 which is shown as a gas supply line interrupter. Alarm 210 provides an indication of the valve position and the system pressure to provide warning as described above.

Figure 10:
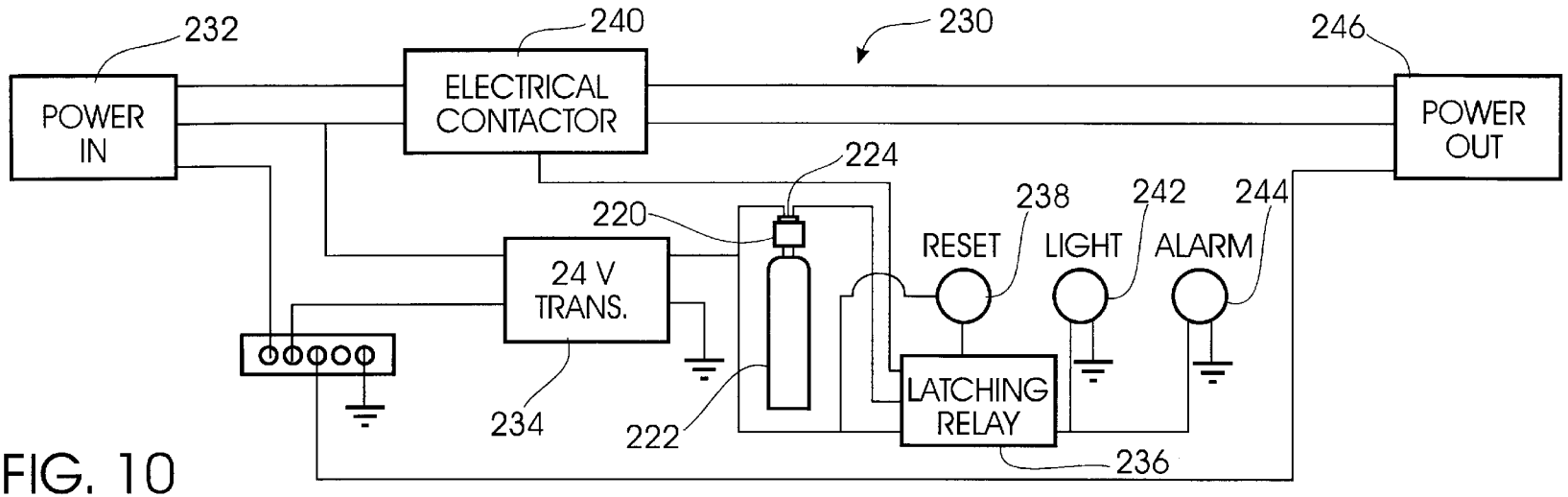
FIG. 10 is a schematic circuit diagram of the unit installation within a fire suppression system which requires the removal of electrical sources of heat (FIG. 8).
Figure 11:
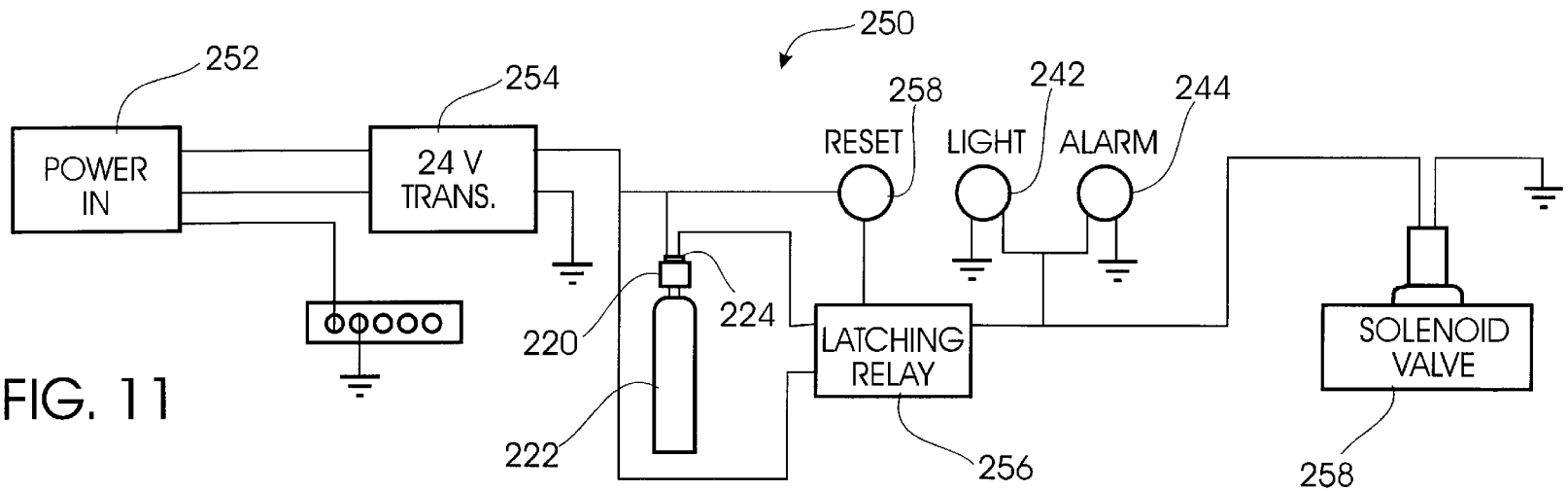
FIG. 11 is a schematic circuit diagram of the unit installation within a fire suppression system which requires the removal of gas supplied sources of heat (FIG. 9).

FIGS. 10 and 11 depict electrical control systems 230 and 250 for alarm, reset, and heat source removal devices for electrical and gas supply situations respectively. The thermocouple activated valve 220 of FIG. 10 is attached to a pressurized fire suppressant supply tank 222 and contains a set of internal position contacts (not shown) which are connected to external means by way of the control connection terminal 224. The opening and closure of the position contacts internal to valve 220 activates and deactivates a heat source removal means operatively connected to the terminal 224. The heat source control means includes a latching relay and an electrical switch or contactor.

FIG. 10 shows a heat source removal switch or contactor 240 for electrical energy disconnect between a power in or supply 232 and a power out (socket) 246 (FIG. 8). The power supply 232 supplies input power to one side of a transformer 234. The other side of the transformer 234 is connected to a first input of the latching relay 236, one side of a reset switch 238, and the input side of the connection terminal 224 of valve 220. The other side of the reset switch 238 is connected to a second input on the latching relay 236. The input side of the connection terminal 224 is connected to the input side of the position contacts of valve 220. The output side of the position contacts is connected to an output side of the connection terminal 224 which is connected to a third input of the latching relay 236. Thus, three paths of power transfer (input) from the power supply 232 to the latching relay 236 are provided. A first output of the latching relay 236 is connected to the electrical contactor 240, and a second output is connected to an alarm 242 and a light 244.

The power supply 232 is also connected to the first side of the electrical contactor 240. The other side of the electrical contactor 240 is connected to power out 246 which provides power to an electrical heat generating device or appliance such as a stove. The electrical contactor 240 allows for power to flow from the power supply 232 to the power out 246 and heat generating device when power is supplied into the contactor 240 from the latching relay 236. If no power is supplied from the latching relay 236, then the electrical contactor 240 disrupts the electrical flow from the power supply 232 to the power out 246 and heat generating device or stove.

The heat source control circuit 230 operates by selectively controlling the flow of electricity through the electrical contactor 240. During the normal non-fire operation of the heat control circuit 230, power flows into the system from the power supply 232 and through the power transformer 234 to the reset 238 and the latching relay 236. This allows for the latching relay 236 to allow power to flow from the transformer 234 through the latching relay 236 and into the electrical contactor 240. The electrical contactor 240 requires an electrical flow from the latching relay 236 to maintain an electrical flow from the power source 232 through the electrical contactor 240 and to the power out 246 and the heat generating means. Upon opening or activation of the valve 220 in response to the excessive heat of a fire, the valve's internal position contacts close and power is provided to a different input of latch relay 236, which latches the relay in the open position, removing power from the electrical contactor 240 which opens to disconnect the flow of energy from the power supply 232 to the power out 246 and heat generating device. Latch relay 236 is then locked in the open position to prevent re-energizing of the heat generating means until the system reset button 238 is pressed and power is allowed to flow through the reset to the latching relay 236. When the latching relay 236 is locked in the open position, the power from the transformer 234 is sent to the alarm 242 and the light 244.

Because power is required to flow from the relay 236 to the electrical contactor 240 to close the contactor, until the valve 220 cools and the position contacts open, the power cannot be restored to the electrical contactor 240. Thus, no power will flow the power out 246 and into the heat generating means or device until after the temperature is reduced to a point that the valve 220 is reclosed.

FIG. 11 shows a gas supply-type heat removal circuit 250 for gas supply shut off (FIG. 9). A power supply 252 supplies input power to one side of a transformer 254. The other side of the transformer 254 is connected to a first input of a latching relay 256, the first side of a reset switch 258, and the input side of the connection terminal 224. The other side of the reset switch 258 is connected to a second input of the latching relay 256. The input side of the connection terminal 224 is connected to the input side of the position contacts of valve 220. The output side of the position contacts is connected to the output side of the connection terminal 224 and then to the latching relay 256. Thus, three paths of power transfer to the latching relay 256 are provided.

A first output of the latching relay 256 is connected to a gas shut off solenoid valve 258, and a second output is connect to the alarm 244 and the light 242.

The gas supply heat removal circuit 250 of FIG. 11 for gas operation works much like the electrical system described above (FIG. 10). When the position contacts of valve 220 are closed, the power from the transformer 254 is input to the second input to latching relay 256 which then shuts off the power to the solenoid valve 258 which shuts off the gas supply. When the power is shut off to the solenoid valve 258, the latching relay turns on power to the light 242 and the alarm 244. The light 242 and the alarm 244 remain activated until the reset 258 is activated and the latching relay 256 returns to non-fire-type operation.

It is contemplated that the alarm 242 and the light 244 can work off their own power supplies such as a battery so that they will be turned on when the power is shut down to the gas solenoid valve 258 without having to supply them with power through latching relay 256. When connected in this manner, the light 242 and the alarm 244 would not be dependent on the power supply 252 or transformer 254 for operation. Note that both a visual and audible alarm are provided to meet notification requirements for handicapped needs. It may also be desirable to have the light 242 and the alarm 244 require a signal from the latching relay 256 before activation in case of a power outage, or other methods of detecting the latching relay 256 activation during a non-power outage could be used.

As shown in FIG. 12, the aircraft-type monitored system circuit 260 includes a system on light 262, a smoke detection alarm 264, a low pressure alarm 266, a valve function or activation alarm 268, a system activation alarm 270, and a system reset 272 (FIG. 7). When the pressure remaining in the fire suppressant storage canister is reduced below a predetermined pressure threshold, the pressure switch closes and power is applied to the low pressure alarm 266 which may include both a visual and audible alarm. Furthermore, the alarms on any system may be adapted to alert ground control as well as the flight crew and to meet notification requirements for handicapped needs.

Figure 13:
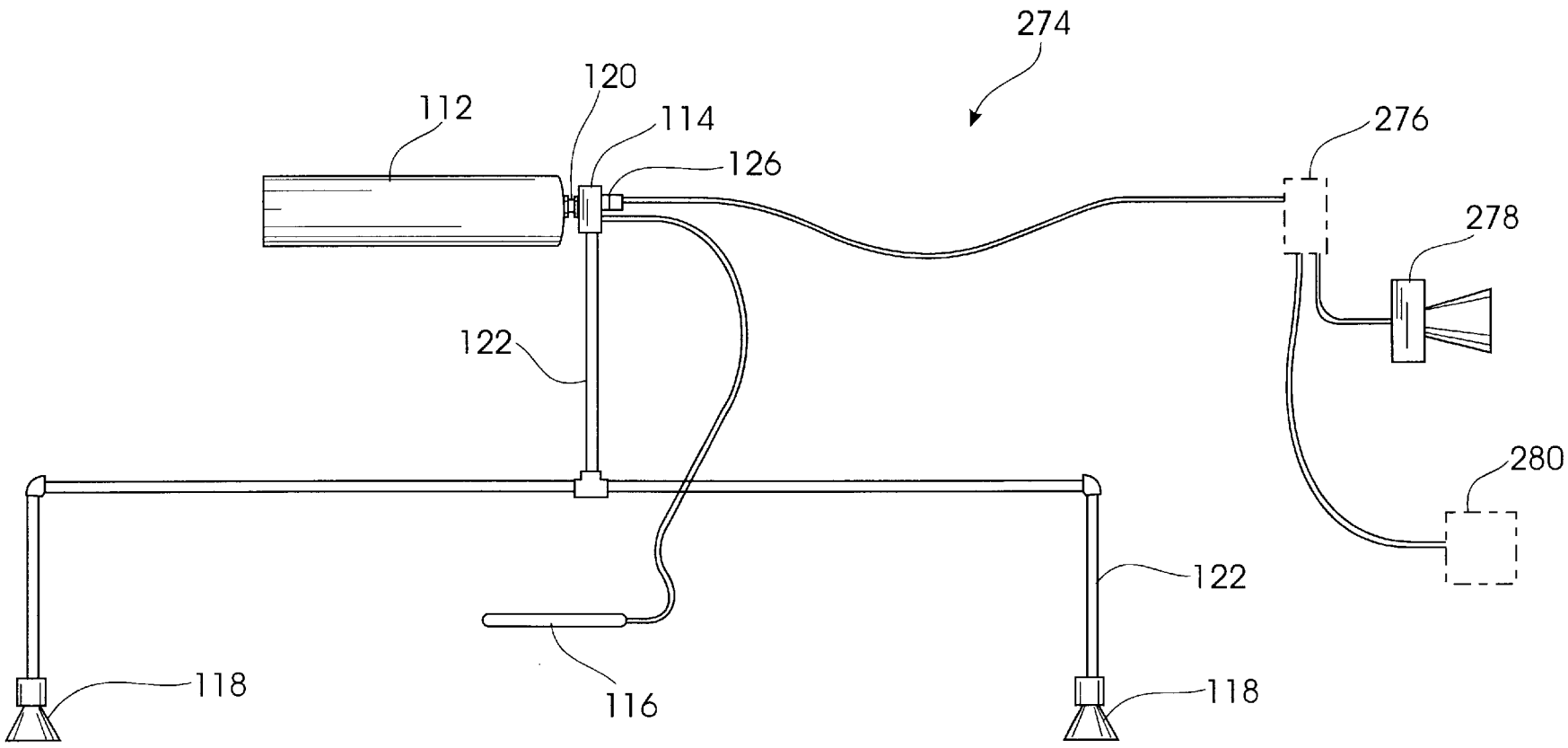
FIG. 13 is a side plan view illustration of one embodiment of the automatic fire suppression unit of the present invention with an alarm and heat source disconnect.

In reference to FIG. 13, the operation of a fire suppression system 274 similar in construction to the system 110 of FIG. 6 and the dispersion of fire suppressant is accomplished in the following manner. As a fire increases the temperature of the fluid within the thermocouple bulb 116, the fluid expands and causes the thermocouple activated valve 114 to open at a preset temperature. This preset temperature is typically around 230 degrees F. or more. This preset temperature will vary depending upon the requirements for the specific application of the unit. The opening of the valve 114 allows for fire suppressant material to travel from pressure cylinder 112, through the piping 120, through the open thermocouple activation valve 114, through the piping 122 and to be expelled from dispersion nozzles 118 into the fire hazard area and extinguish the flame. When the valve opens, contacts in the valve 114 close and cause a control circuit 276 to activate an appropriate alarm means 278 to sound an alarm, and heat source removal means 280 is activated to stop the flow of gas or electricity to prevent further additional heat to be supplied to the fire hazard area if necessary.

With the extinguishing of the flame and the subsequent reduction in temperature, the fluid in thermocouple bulb 116 contracts and causes thermocouple activated valve 114 to automatically close. Thus, only the portion of fire suppression material necessary to extinguish the flame is expelled and the remaining portion of the fire suppressant material is retained for later dispersion should re-ignition occur. This closure of the valve 114 causes the valve contacts to open and eliminate the signals to the alarm means 278 and heat source removal means 280. Control circuit 276 may receive electrical power from a battery or an outside 110 or 220 volt power source.

FIG. 14 shows a schematic embodiment of a heat source removal means 280 having an electrical plug 300, a connection cable 302, a control box 304 which contains the components to remove electrical power from, for example, an electric stove including a transformer 306, electrical receptacle 308, switch 310, ground plate 312, electrical contacts 314, and wiring 316 to control box 276 or an exiting or existing conduit 316 to a vent hood.

In a non-fire, non-thermocouple activated valve, or temperature sensitive valve non-activation condition, electrical energy passes from plug 300 along line 302 through switch 310 to electrical contacts 314 of receptacle 308. Hence, the range or other appliance plugged into receptacle 308 receives electrical energy and is able to provide heat from the burners or heating elements thereof.

When a fire condition exists and the thermocouple activated valve or temperature sensitive activated valve is tripped to the open position, a signal is sent along line 316 which causes the switch 310 to open and thereby break the electrical connection from plug 300 to receptacle 308. Thus, electrical energy is cut off from the electrical appliance, stove, range, or the like.

Prior fire suppression devices suffer from several drawbacks including that they were designed primarily for commercial applications, do not effectively remove the heat source which fuels the fire, dump their entire supply of fire suppressant upon activation, and as such are not available should re-ignition occur.

The present device, which in one embodiment is designed to be concealed within a vent-a-hood, responds to the high temperatures generated in a stovetop fire. The fire suppressant is released and at the same time the power supply (electricity or gas) is disconnected to remove the heat source.

In one of its simplest forms, the device includes a cylinder of pressurized fire suppressant, such as $CO_2$, FM200, and/or dry chemical which is released when a snap action thermocouple valve responds to a high temperature condition. Once the fire is extinguished, the thermocouple will cool and act to close the valve, thus retaining additional suppressant in the cylinder should re-ignition occur. A sensor within the thermocouple valve detects that the system has discharged which activates the alarm and also activates an electrical circuit to either close a gas valve or disconnect the electrical power.

The electrical circuitry is designed such that loss of power to the present unit will disconnect the fuel or power source; however, the unit will still be available to discharge fire suppressant if a fire were to occur in the protected area.

The present device is especially adapted for use in a confined space such as a utility room, closet, laundry room, garage, file room, control room, machine room, storage space, engine compartment, and the like.

The present invention is directed to an automatic fire suppression unit and method for use in various fire exposures where the area in which a fire can occur is limited, manually operated portable extinguishment is either impractical or not recommended, the ability to provide additional suppression in the event of re-ignition is crucial to fire safety, or the ability to limit environmental impact of the fire suppressant is desired. The system includes a tank containing a suitable fire extinguishing agent and equipped with a temperature activated valve to discharge the extinguishing agent when a thermocouple or metallic alloy element responds to a high temperature condition and opens the valve. When the fire has been suppressed and a high temperature condition no longer exists, the valve closes and stops the discharge of suppressant. Position indication contacts within the valve are utilized to activate appropriate alarms and to remove electrical or gas supply if necessary.

The present invention is also directed to an automatic home fire suppression unit or units adapted to automatically activate under extreme heat and discharge a non-toxic gas referred to as FM200 which acts as a flame retardant by attacking the molecules that are burning. These units are adapted to be located in the hot spots in a home which include the kitchen, hot water heater, furnace, and/or storage room. The kitchen unit is adapted to fit into the stove vent hood and automatically opens for discharge of the non-toxic gas when a thermocouple senses the extreme heat produced by a stovetop fire. The unit shuts off the stove and also sounds an alarm upon the sensing of a stovetop fire. The unit ceases to discharge the non-toxic fire retardant gas when the thermocouple senses that the fire has been extinguished.

While the foregoing detailed description has described several embodiments of the fire suppression apparatus, system, unit, or device and method in accordance with this invention, it is to be understood that the above description is illustrative only and not limiting of the disclosed invention. Thus, the invention is to be limited only by the claims as set forth below.

What is claimed is:

1. A fire suppression unit, comprising:

a pressurized cylinder of suitable propellant gas;

a self-contained automatic temperature activated valve attached to said cylinder and which automatically opens upon sensing a fire, automatically closes upon sensing cessation of the fire, and thereby may provide for additional fire suppression in the event of fire re-ignition;

a suitable fire suppressant chemical cylinder attached to said temperature activated valve; and, a nozzle attached to said fire suppressant cylinder, wherein said nozzle and said temperature activated valve are located in a fire protection area.

2. The fire suppression unit according to claim 1, further comprising at least one additional nozzle attached to said cylinder.

3. The fire suppression unit according to claim 1, wherein said unit is compact and adapted to be located in a residential stove or range vent hood.

4. The fire suppression unit according to claim 1, wherein said valve is a snap-action temperature sensitive valve.

5. A fire suppression unit, comprising:

a pressurized cylinder of suitable propellant gas;

a temperature activated valve attached to said cylinder;

a suitable fire suppressant chemical cylinder attached to said temperature activated valve;

a nozzle attached to said fire suppressant cylinder, wherein said nozzle and said temperature activated valve are located in a fire protection area; and, an alarm circuit, wherein said alarm circuit is activated by position indication contacts within said temperature activated valve.

6. The fire suppression unit according to claim 5, further comprising:

a pressure sensor attached to said pressurized cylinder of propellant gas, wherein said sensor is used for detecting when the pressure of said gas has fallen below a predetermined pressure, wherein said fire suppression system alarm is coupled to said pressure sensor whereby when said pressure sensor senses said predetermined fallen pressure, said pressure sensor causes said alarm to activate.

7. The fire suppression unit according to claim 5, further including a radio transmitter activated by said valve position contacts.

8. The fire suppression unit according to claim 7, further including a radio receiver and an electrical energy shut off, wherein the detection of a fire by said valve causes said valve position contacts to close and cause the transmission and receiving of a radio signal, and receiving of said signal causes the operation of said shut off to remove electrical energy supply from an appliance or equipment.

9. The fire suppression unit according to claim 7, further including a radio receiver and a gas supply shut off, wherein the detection of a fire by said valve causes said valve position contacts to close and cause the transmission and receiving of a radio signal and causes the operation of said shut off to remove gas supply from an appliance or equipment.

10. The fire suppression unit according to claim 5, further including a reset and a latching relay, wherein the detection of a fire by said valve causes said valve position contacts to close and activate said latching relay, said reset is used to deactivate or reset said latching relay.

11. The fire suppression unit according to claim 5, wherein said temperature activated valve automatically opens upon sensing a fire, automatically closes upon sensing cessation of the fire, and thereby may provide for additional fire suppression in the event of fire re-ignition.

12. A fire suppression unit, comprising:

a pressurized cylinder of suitable propellant gas;

a temperature activated valve attached to said cylinder;

a suitable fire suppressant chemical cylinder attached to said temperature activated valve;

a nozzle attached to said fire suppressant cylinder, wherein said nozzle and said temperature activated valve are located in a fire protection area, and, wherein said temperature activated valve includes a thermocouple bulb for sensing the presence of a fire and automatically opens upon sensing a fire, automatically closes upon sensing cessation of the fire, and thereby may provide for additional fire suppression in the event of fire re-ignition.

13. A fire suppression unit, comprising:

a container suitable for holding a pressurized fire suppressant;

an automatic temperature sensitive valve operatively attached to said container, wherein said valve automatically opens in response to the temperature of a fire to start the release of said suppressant, and wherein said valve automatically closes and stops the release of said suppressant and resets itself for further operation once it has cooled below the temperature of a fire; and, a dispersion nozzle operatively attached to said valve to control the dispersion of said suppressant.

14. The fire suppression unit according to claim 13, wherein said valve has electrical contacts to signal an open or closed position of said valve by closing and opening said contacts.

15. The fire suppression unit according to claim 14, further comprising:

an alarm means for signaling the opening of said valve, wherein said alarm is activated and deactivated in corresponding relation to said position of said electrical contacts.

16. The fire suppression unit according to claim 14, further comprising:

a light means for signaling the opening of said valve, wherein said light is activated and deactivated in corresponding relation to said position of said contacts.

17. The fire suppression unit according to claim 14, further comprising:

a heat source removal means for blocking at least one of fuel and electricity upon the opening of said valve, wherein said heat source removal means is activated and deactivated in corresponding relation to said position of said electrical contacts.

18. A fire suppression apparatus comprising:

a detecting means for detecting a fire;

a signal creating means for creating a fire signal and which is connected to said detecting means;

a radio transmitter for transmitting said fire signal and which is operatively connected to said signal creating means;

a radio receiver for receiving said transmitted fire signal; and, a means for disabling a heat source operatively controlled by said receiving means.

19. The fire suppression apparatus of claim 18, wherein said detecting means is a temperature activated valve.

20. The fire suppression apparatus according to claim 18, wherein said detecting means includes a temperature activated valve which automatically opens upon sensing a fire, automatically closes upon sensing cessation of the fire, and thereby may provide for additional fire suppression in the event of fire re-ignition.

21. A fire suppression apparatus comprising:

a detecting means for detecting a fire;

a signal creating means for creating a fire signal and which is connected to said detecting means;

a transmitting means for transmitting said fire signal and which is operatively connected to said signal creating means;

a receiving means for receiving said transmitted fire signal;

a means for disabling a heat source operatively controlled by said receiving means;

a pressurized gas cylinder;

an input side of a temperature activated valve connected to said pressurized gas cylinder;

an output side of said temperature activated valve connected to an input connection on a fire retardant containment cylinder; and, an output side of said fire retardant containment cylinder operatively connected to a dispersion nozzle, wherein the activation of said valve causes the pressurized gas cylinder to release a pressurized gas which flows through said valve, into said fire retardant containment cylinder where it mixes with a fire retardant material and the combined gas and material flow out through said dispersion nozzle.

22. The fire suppression apparatus according to claim 21, wherein said temperature activated valve automatically opens upon sensing a fire, automatically closes upon sensing cessation of the fire, and thereby may provide for additional fire suppression in the event of fire re-ignition.

23. A fire suppression apparatus comprising:

detecting means for detecting a fire including a thermocouple bulb;

a signal creating means for creating a fire signal and which is connected to said detecting means;

a transmitting means for transmitting said fire signal and which is operatively connected to said signal creating means;

a receiving means for receiving said transmitted fire signal; and, a means for disabling a heat source operatively controlled by said receiving means.

24. The fire suppression apparatus according to claim 23, wherein said apparatus includes a valve operated by said thermocouple bulb which automatically opens upon sensing a fire, automatically closes upon sensing cessation of the fire, and thereby may provide for additional fire suppression in the event of fire re-ignition.

25. A fire suppression apparatus comprising:

a pressurized gas cylinder;

a self-contained automatic temperature activated valve;

an input side of said temperature activated valve connected to said pressurized gas cylinder;

a fire retardant containment cylinder;

an output side of said temperature activated valve connected to an input connection on said fire retardant containment cylinder;

a dispersion nozzle;

an output side of said fire retardant containment cylinder operatively connected to said dispersion nozzle, wherein the activation of said valve causes the pressurized gas cylinder to release a pressurized gas which flows through said valve, into said fire retardant containment cylinder where it mixes with a fire retardant material and the combined gas and material flow out through said dispersion nozzle, and deactivation of said valve causes said pressurized gas cylinder to stop releasing pressurized gas.

26. A fire suppression apparatus comprising:

a self-contained automatic temperature activated valve for detecting a fire and for creating a fire signal;

a transmitting means for transmitting said fire signal and which is operatively connected to said valve;

a receiving means for receiving said transmitted fire signal; and, a means for disabling a heat source operatively controlled by said receiving means.

27. A fire suppression apparatus comprising:

a pressurized gas cylinder;

a thermocouple activated valve;

a thermocouple bulb for detecting a fire and activating the thermocouple activated valve;

an input side of the valve connected to said pressurized gas cylinder;

a fire retardant containment cylinder;

an output side of said valve connected to an input connection on the fire retardant containment cylinder;

a dispersion nozzle;

an output side of said fire retardant containment cylinder operatively connected to the dispersion nozzle, wherein the activation of said valve causes the pressurized gas cylinder to release a pressurized gas which flows through said valve, into said containment cylinder where it mixes with a fire retardant material and the combined gas and material flow out through said dispersion nozzle.

* * * * *